US009033200B2

(12) United States Patent
de Jong et al.

(10) Patent No.: US 9,033,200 B2
(45) Date of Patent: May 19, 2015

(54) METHOD AND DEVICE FOR CONTROLLING TENSION APPLIED TO A MEDIA WEB

(75) Inventors: Joannes N. M. de Jong, Hopewell Junction, NY (US); Paul S. Bonino, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 756 days.

(21) Appl. No.: 13/400,177

(22) Filed: Feb. 20, 2012

(65) Prior Publication Data

US 2013/0214023 A1 Aug. 22, 2013

(51) Int. Cl.

| | |
|---|---|
| ***B65H 23/188*** | (2006.01) |
| ***B65H 23/192*** | (2006.01) |
| ***B41J 11/42*** | (2006.01) |
| ***B65H 23/04*** | (2006.01) |
| ***B41J 15/16*** | (2006.01) |
| ***B41J 2/175*** | (2006.01) |

(52) U.S. Cl.

CPC ..... *B41J 11/42* (2013.01); *B65H 23/1888* (2013.01); *B65H 23/192* (2013.01); *B65H 23/044* (2013.01); *B41J 15/165* (2013.01); *B41J 2/17593* (2013.01)

(58) Field of Classification Search

CPC .. B41J 15/18; B41J 15/165; B65H 23/18888; B65H 23/192; B65H 23/044

See application file for complete search history.

(56) References Cited

U.S. PATENT DOCUMENTS

| | | | | |
|---|---|---|---|---|
| 3,837,550 | A | 9/1974 | Levy | |
| 3,912,145 | A | 10/1975 | Meihofer | |
| 4,076,184 | A | 2/1978 | Morgan | |
| 4,363,457 | A | 12/1982 | Flint et al. | |
| 4,369,906 | A | 1/1983 | Isherwood | |
| 4,513,898 | A | 4/1985 | Spitsbergen | |
| 5,260,716 | A | 11/1993 | Maslanka | |
| 5,470,005 | A | 11/1995 | King et al. | |
| 5,712,489 | A | 1/1998 | Elvidge et al. | |
| 5,878,933 | A | 3/1999 | Laughery | |
| 6,085,956 | A | 7/2000 | Sainio et al. | |
| 6,098,864 | A | 8/2000 | Fuchs et al. | |
| 6,106,177 | A | 8/2000 | Siegl et al. | |
| 6,160,978 | A | 12/2000 | Tsuruoka et al. | |
| 6,233,495 | B1 | 5/2001 | Chen | |
| 6,293,539 | B1 | 9/2001 | Fukatsu et al. | |
| 6,381,440 | B1 | 4/2002 | Bock et al. | |
| 6,499,639 | B2 | 12/2002 | Cote et al. | |
| 6,596,108 | B2 | 7/2003 | McCabe | |
| 6,851,367 | B2 | 2/2005 | Vaidyanathan et al. | |
| 7,017,485 | B2 | 3/2006 | Albert et al. | |
| 7,118,062 | B2 | 10/2006 | Vaidyanathan et al. | |
| 7,130,571 | B2 | 10/2006 | Berg et al. | |
| 7,467,838 | B2 | 12/2008 | Folkins et al. | |
| 7,510,256 | B2 | 3/2009 | Guarino et al. | |
| 2001/0006029 | A1 | 7/2001 | Ogawa et al. | |
| 2004/0118892 | A1 * | 6/2004 | Weber et al. | 226/44 |
| 2006/0221124 | A1 | 10/2006 | Guarino et al. | |
| 2010/0046014 | A1 | 2/2010 | Eun et al. | |
| 2010/0108733 | A1 | 5/2010 | Fuwa | |
| 2010/0243698 | A1 | 9/2010 | Hashimoto | |

* cited by examiner

*Primary Examiner* — William E Dondero

(74) *Attorney, Agent, or Firm* — Maginot Moore & Beck LLP

(57) ABSTRACT

In a web printer, tension on the moving web is controlled by monitoring the tension on the web between two rollers and selectively operating an actuator driving the second roller to restore the tension to an acceptable range. The operation of the actuator includes modulating the speed at which the second roller is driven.

17 Claims, 7 Drawing Sheets

METHOD AND DEVICE FOR CONTROLLING TENSION APPLIED TO A MEDIA WEB

TECHNICAL FIELD

This disclosure relates generally to methods for controlling a tension applied to a web member moving through a device, and more particularly to methods for maintaining tension applied to media webs in printers.

BACKGROUND

In general, inkjet printing machines or printers include at least one printhead unit that ejects drops of liquid ink onto recording media or an imaging member for later transfer to media. Different types of ink may be used in inkjet printers. In one type of inkjet printer, phase change inks are used. Phase change inks remain in the solid phase at ambient temperature, but transition to a liquid phase when heated to a melting temperature. The printhead unit ejects melted ink supplied to the unit onto media or an imaging member. Once the ink is ejected onto media, the ink droplets quickly solidify.

The media used in both direct and offset printers may be in web form. In a web printer, a continuous supply of media, typically provided in a media roll, is entrained onto rollers that are driven by motors. The motors and rollers pull the web from the supply roller through the printer to a take-up roll. The rollers are arranged along a linear media path, and the media web moves through the printer along the media path. As the media web passes through a print zone opposite the printhead or heads of the printer, the printheads eject ink onto the web.

Moving the web through the media path in a controlled manner presents challenges to web printing systems. As the media web moves through various portions of the media path, one or more of the rollers apply tension to the web. An appropriate level of tension between the media web enables the media web to engage the rollers in the media path via friction without slipping. During operation, however, one or more rollers that contact the media web may slip relative to the motion of the web, resulting in a drop in the tension of the media web. Various causes of the drop in tension include excess slack introduced by a media web winder or rewinder, variations in the rotational rates of two or more drive rollers that are positioned on the media path, and a loss of friction between the media web and a roller due to oil or other substance on the web that reduces the coefficient of friction between the media web and the roller.

If the web slips when engaged with one or more rollers in the media path, the position of the media web with respect to the printheads is affected and errors in images formed on the media web may occur. Media slippage may produce positional errors based on calculations of web velocity because the actual velocity of the web and the web velocity identified with respect to the angular velocity of the rollers differ. These positional errors may adversely impact the effectiveness of registration techniques that coordinate the operation of multiple printheads to form ink images on the media web. When a media web slips over rollers in the media path, one solution known to the art increases a normal force between one or more rollers and the media web to reduce or eliminate the slip and restore tension to the web. The increased normal force applied to the media web may be great enough to distort or break the media web. Thus, improvements in operating continuous web printing systems to reduce slip on the media web while maintaining the normal force that is applied to the media web within an operating range would be beneficial.

SUMMARY

In one embodiment, a method of adjusting operation of a printing apparatus has been developed. The method includes moving a web over a first roller and along a media path in a process direction at a web linear velocity, operating an actuator to rotate a second roller that is in contact with the web, the second roller being at a location on the media path that is offset from the first roller in the process direction, identifying at least one of a first velocity difference and a second velocity difference between a linear velocity of the second roller and at least one of a linear velocity of the first roller and the web linear velocity, respectively, the at least one of the first and second velocity differences being positive when the linear velocity of the second roller is greater than the at least one of the linear velocity of the first roller and the web linear velocity, respectively, and adjusting operation of the actuator to modulate the linear velocity of the second roller between a first linear velocity and a second linear velocity in response to the identified at least one of the first and second velocity differences being positive and above at least one of a first velocity differential threshold and a second velocity differential threshold, respectively, the first linear velocity being greater than the second linear velocity and the first and second linear velocities being greater than the at least one of the linear velocity of the first roller and the web linear velocity.

A printing apparatus that is configured to adjust tension on a media web has been developed. The apparatus includes a plurality of rollers configured to move a media web along a media path in a process direction, a first roller in the plurality of rollers rotates to move the web in the process direction at a web linear velocity, and a second roller in the plurality of rollers is positioned along the media path at a location that is offset from the first roller in the process direction, an actuator operatively connected to the second roller, the actuator being configured to rotate the second roller to move the media web past the second roller in the process direction, and a controller operatively connected to the actuator, the controller being configured to operate the actuator to adjust a rotation of the second roller to move the media web past the second roller, identify at least one of a first velocity difference and a second velocity difference between a linear velocity of the second roller and at least one of a linear velocity of the first roller and the web linear velocity, respectively, the at least one of the first and second velocity differences being positive when the linear velocity of the second roller is greater than the at least one of the linear velocity of the first roller and the web linear velocity, respectively, and adjust operation of the actuator to modulate a linear velocity of the second roller between a first linear velocity and a second linear velocity in response to the identified at least one of the first and second velocity differences being positive and above at least one of a first velocity differential threshold and a second velocity differential threshold, respectively, the first linear velocity being greater than the second linear velocity and the first and second linear velocities being greater than the at least one of the linear velocity of the first roller and the web linear velocity.

DETAILED DESCRIPTION

Figure 1:
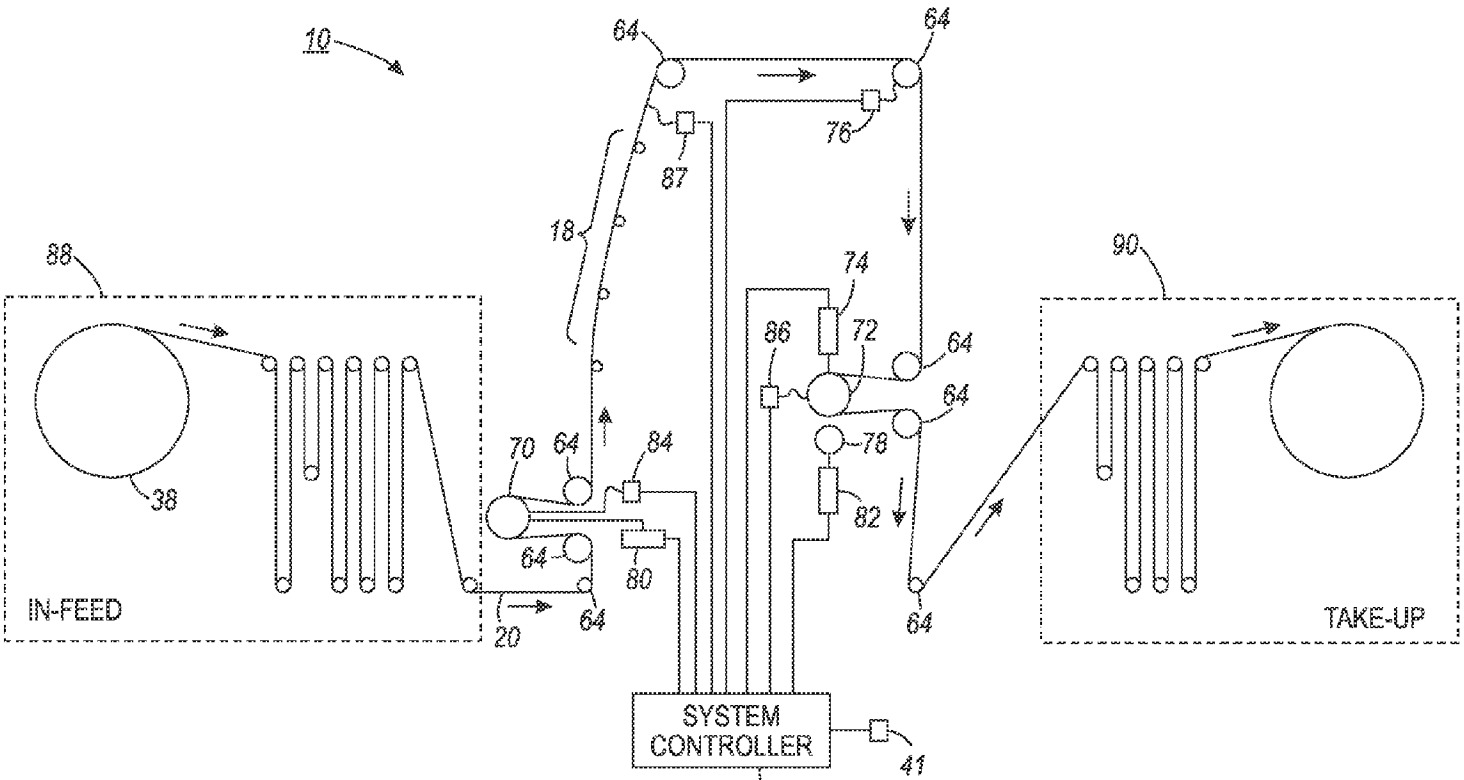
FIG. 1 is a block diagram of a prior art printer modified to operate a web tension control method as disclosed herein.

For a general understanding of the environment for the system and method disclosed herein as well as the details for the system and method, the drawings are referenced throughout this document. In the drawings, like reference numerals designate like elements. As used herein the term "printer" refers to any device that is configured to eject a marking agent upon an image receiving member and includes photocopiers, facsimile machines, multifunction devices, as well as direct and indirect inkjet printers and any imaging device that is configured to form images on a print medium. As used herein, the term "process direction" refers to a direction of travel of an image receiving member, such as an imaging drum or print medium, and the term "cross-process direction" is a direction that is perpendicular to the process direction along the surface of the image receiving member. As used herein, the terms "web," "media web," and "continuous media web" refer to an elongated print medium that is longer than the length of a media path that the web traverses through a printer during the printing process. Examples of media webs include rollers of paper or polymeric materials used in printing. The media web has two sides forming surfaces that may each receive images during printing. Each surface of the media web may be viewed as a grid-like pattern of potential drop locations, sometimes referred to as pixels.

As used herein, the term "capstan roll" refers to a cylindrical member that is configured to have continuous contact with media web moving over a curved portion of the member and to rotate in accordance with a linear motion of the continuous media web. As used herein, the term "angular velocity" refers to the angular movement of a rotating member for a given time period, sometimes measured in rotations per second or rotations per minute. The term "linear velocity" refers to the velocity of a member, such as a media web, moving in a straight line. When used with reference to a rotating member, the linear velocity represents the tangential velocity at the circumference of the rotating member. The linear velocity $v$ for circular members may be represented as: $v=2\pi r\omega$ where $r$ is the radius of the member and $\omega$ is the rotational or angular velocity of the member. A media web that is in contact with a roller slips when the tension differential across the roller is greater than what the capstan friction $e^{\mu\theta}$ can support to enable traction. In identifying capstan friction, $\mu$ represents the coefficient of friction of the capstan roller, and $\theta$ represents the angle of the surface of the capstan roller that contacts the media web. Media web slip generates velocity errors between the media web that is in contact with the roller and the surface of the roller.

Figure 6:
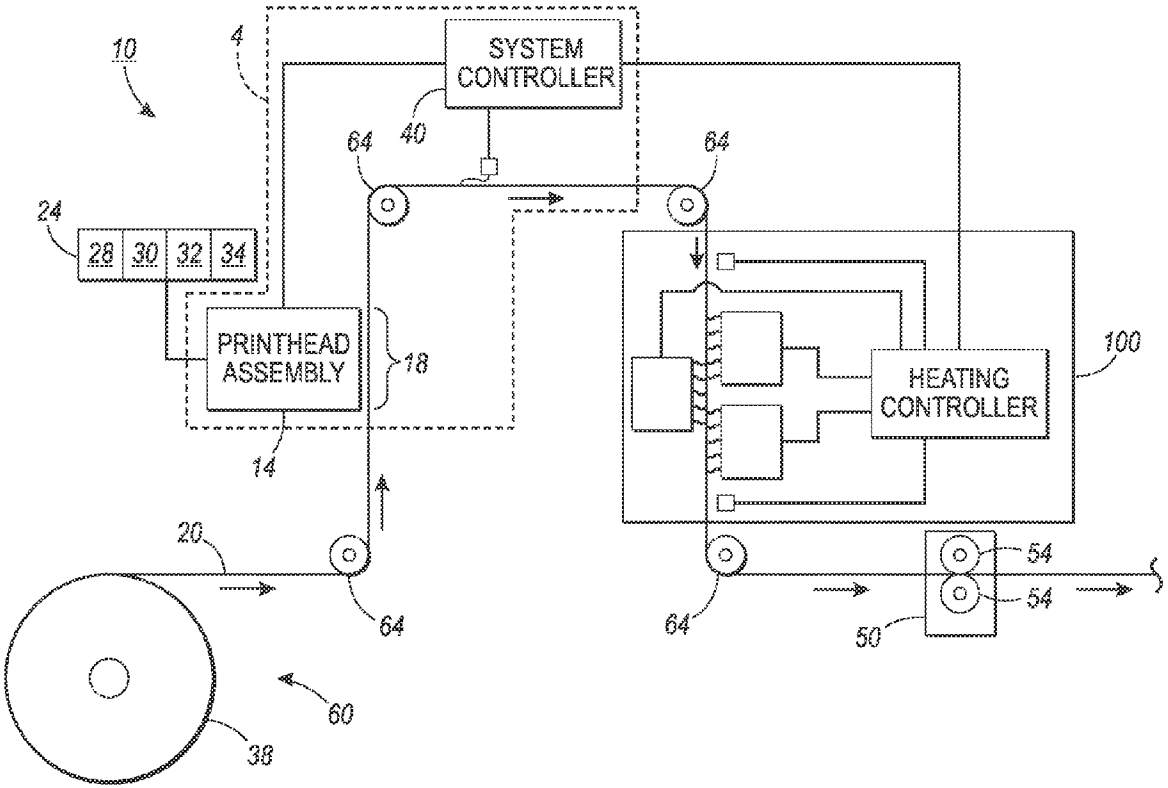
FIG. 6 (Prior Art)
FIG. 6 is a block diagram of a prior art inkjet printing system in which the web tension control method disclosed herein may be used.

FIG. 6 depicts a prior art inkjet printer 10 having elements pertinent to the present disclosure. In the embodiment shown, the printer 10 implements a solid ink print process for printing onto a continuous media web. Although the media web tension control method and apparatus are described below with reference to the printer 10 depicted in FIG. 6, the subject method and apparatus disclosed herein may be used in any printer, such as a cartridge inkjet printer, which uses serially arranged printheads to eject ink onto a web image substrate.

The printer 10 includes a web supply and handling system 60, a printhead assembly 14, a web heating system 100, and a fixing assembly 50. The web supply and handling system 60 includes one media supply roll 38 for supplying a media web 20 to the printer 10. The supply and handling system 60 is configured to feed the media web 20 in a known manner along a media pathway in the printer 10 through a print zone 18 located adjacent to the printhead assembly 14, past the web heating system 100, and through the fixing assembly 50. To this end, the supply and handling system 60 includes any suitable device 64, such as drive rollers, idler rollers, tensioning bars, etc., for moving the media web 20 through the printer 10. The printer 10 includes a take-up roll (not shown) for receiving the media web 20 after printing operations have been performed. Alternatively, the media web 20 can be fed to a cutting device (not shown) as is known in the art for cutting the media web into discrete sheets. The printhead assembly 14 is appropriately supported to eject drops of ink directly onto the media web 20 as the web moves through the print zone 18. In other printers in which the media web tension control method and apparatus is used, the printhead assembly 14 is configured to eject drops onto an intermediate transfer member (not shown), such as a rotating drum or belt, for subsequent transfer to a media web or media sheets.

Figure 7:
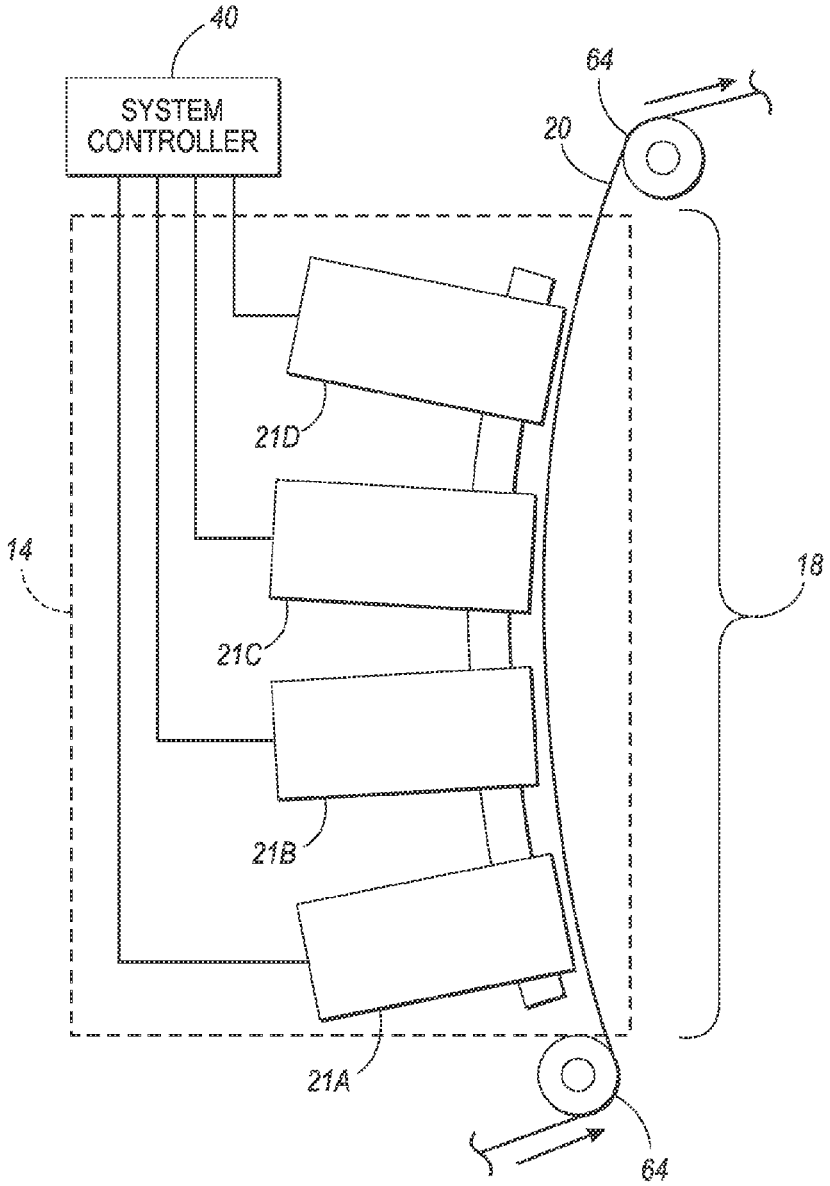
FIG. 7 is an enlarged view of a printhead assembly included within the inkjet printing system showing an arrangement of a series of printhead modules used to eject ink of different colors.

Referring to FIG. 7, the printhead assembly 14 includes a series of printhead modules 21A, 21B, 21C, and 21D with each printhead module effectively extending across the width of the media web 20. As is generally familiar, each of the printhead modules 21A, 21B, 21C, and 21D selectively ejects a single color of ink. In some embodiments, each module ejects one color of ink typically used in color printing; namely, the primary colors cyan, magenta, yellow, and black (CMYK). The printhead module for each primary color typically includes two or more serially arranged printheads with the multiple printheads formed into a multiple row array. Although the embodiment shown discloses a series of printhead modules, a printer may include as few as one printhead module for printing images using only one color, such as black. A plurality of inkjets is arranged in a row and column fashion on each printhead. Each of the inkjets is coupled to a source of liquid ink and each one ejects ink through an inkjet nozzle in response to a firing signal being received by an inkjet actuator, such as a piezoelectric actuator, in the inkjet.

Referring again to FIG. 6, the printer 10 uses "phase-change ink," by which is meant ink that is substantially solid at room temperature and that transitions to a liquid phase when heated to a phase change ink melting temperature. The melted ink is provided to the printheads for jetting onto the image receiving surface. The phase change ink melting temperature is any temperature that is capable of melting solid phase change ink into liquid or molten form. In one embodiment, the phase change ink melting temperature is approximately 70° C. to 140° C. In alternative embodiments, the ink utilized in the printer is UV curable gel ink. Gel ink is heated to change the viscosity of the ink from a gel to a liquid phase before the ink is ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Ink is supplied to the printhead assembly from a solid ink supply 24. In aqueous or emulsion ink systems, which use the media web tension control method and apparatus disclosed herein, the liquid ink may be stored in one or more volumetric containers installed in the printer. Since the printer 10 of FIG. 6 is a phase change ink multicolor device, the ink supply 24 includes four sources of solid phase change ink, including a cyan source 28, a yellow source 30, a magenta source 32, and a black source 34. The imaging device 10 also includes a solid phase change ink melting and control assembly or apparatus (not shown) for melting the solid form of the phase change ink into a liquid form, and then supplying the liquid ink to the printhead assembly 14. Each color of ink is supplied to one of the series of printhead modules 21A, 21B, 21C, and 21D within the printhead assembly 14. The differently colored inks are supplied through separate conduits. A single line connects the ink supply 24 with the printhead assembly 14 in FIG. 6 to simplify the representation depicted in the figure.

Referring still to FIG. 6, operation and control of the various subsystems, components, and functions of the printer 10 are performed with the aid of a controller 40. In some embodiments, the controller 40 is implemented with general or specialized programmable processors that execute programmed instructions. The instructions and data required to perform the programmed functions are stored in memory associated with the processors or controllers. The processors, their memories, and interface circuitry configure the controllers and/or print engine to perform the printer functions described above. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In order to form an image with the ink ejected by the printhead assembly 14, image data received by the printer 10 are converted into firing signals that selectively actuate the inkjets in the printheads to eject ink onto the web 20 as the web 20 moves past the printhead assembly 14. The controller 40 receives velocity data from encoders mounted proximately to rollers positioned on either side of the portion of the path opposite the four printhead modules 21A, 21B, 21C, and 21D to compute the position of the web 20 as the web moves past the printhead modules 21A, 21B, 21C, and 21D. The controller 40 uses this velocity data to generate timing signals that are delivered to printhead controllers in the printhead modules that enable the printhead controllers to generate firing signals that actuate selected inkjet ejectors in the printheads. The inkjet ejectors actuated by the firing signals correspond to image data processed by the controller 40.

Referring still to FIG. 6, after drops of ink are ejected onto the moving web 20 within the print zone 18 to form an image, the web 20 continues along the media path so that the image passes through a fixing assembly 50, which fixes the ink drops to the web 20. In the embodiment shown, the fixing assembly 50 comprises at least one pair of fixing rollers 54 that are positioned in relation to each other to form a nip through which the media web 20 is fed. The ink drops on the media web 20 are pressed into and spread out on the web 20 by the pressure formed by the nip. Although the fixing assembly 50 is depicted as a pair of fixing rollers 54, the fixing assembly can be any suitable type of device or apparatus, as is known in the art, which is capable of fixing, drying, or curing an ink image onto the media.

Referring now to FIG. 1, the prior art printer system modified to operate the web tension control method disclosed herein is shown. The printer 10 includes a web system for delivering a continuous supply of media web 20 to the media path of the printer. The web system includes an in-feed section 88 for storing and delivering the media web 20, a printing section or print zone 18 for printing images on the web 20, and a take-up section 90 for rewinding and storing the web 20 after printing. The configuration of the different sections 18, 88, 90 as shown in FIG. 1 enables the media web 20 to be moved from left to right. The media path of the printer 10 includes both a first roller 70 located upstream of the print zone 18 and a second roller 72 located downstream of the print zone 18. In the embodiment shown, the first and second rollers 70, 72 are circular, each being rotable about an axis and having an outer circumference about the axis. The media path is configured to provide sufficient wrap of the media web 20 about the first and second rollers 70, 72 to enable a tension force to be generated along the web between the rollers 70, 72. In the disclosed embodiment, the media path provides sufficient wrap about the first and second rollers 70, 72, by being configured to place at least one half of the outer circumferences of the first and second rollers 70, 72 in contact with the media web. The normal force and the coefficient of friction of the interface between the media web 20 and the rollers 70, 72 determine the maximum force generated along the web 20. The tension of the media web 20 is measured by a tension sensor 76 located along the media path between the first and second rollers 70, 72.

The second roller 72 is configured to adjust the tension of the media web 20 in response to the measured tension being below a predetermined tension threshold. As used herein, the term "predetermined tension threshold" is a tension value or a range of tension values that enable the media web 20 to engage the first and second rollers 70, 72 by means of static, or non-slip, friction and that do not distort or break the media web 20. When the web tension is at or within the predetermined tension threshold, web tension adjustment is achieved by operating an actuator 74 to increase or decrease a rotation of the second roller 72 to respectively increase or decrease the web tension. However, when the web tension is below the predetermined tension threshold, such as when transient conditions of low friction or insufficient normal force exist between the rollers 70, 72 and the media web 20, the second roller 72 is unable to impose sufficient force along the web 20 by increasing the rotation of the second roller 72 alone.

The web tension control method disclosed herein varies operation of the actuator 74 to increase the tension of the media web 20 when the measured web tension is below the predetermined tension threshold. In one embodiment, proper tensioning is achieved by operating the actuator 74 to modulate a linear velocity of the second roller 72 between different linear velocities. In another embodiment, proper tensioning is achieved by deactivating the actuator 74 to enable the second roller 72 to rotate at a linear velocity of the web 20. In yet another embodiment, proper tensioning is achieved by selectively activating and deactivating the actuator 74 to enable the second roller 72 to rotate at the linear velocity of the web. In yet another embodiment, proper tensioning is achieved by identifying the linear velocity of the web and operating the actuator 74 to rotate the second roller 72 with the identified linear velocity.

The web tension control method can also operate additional actuators in association with the actuator 74 to increase the tension of the media web 20 when the measured web tension is below the predetermined tension threshold. In one embodiment, proper tensioning is achieved by rotating the first roller 70 with a second actuator 80 and operating the actuator 74 to modulate the linear velocity of the second roller 72 between different linear velocities. In another embodiment, proper tensioning is achieved by operating the second actuator 80 to rotate the first roller 70 to move the web 20 a predetermined distance along the media path and operating the actuator 74 to rotate the second roller 72 after the web 20 has moved the predetermined distance. In yet another embodiment, proper tensioning is achieved by operating a third actuator 82 to engage a third roller 78 with the second roller 72 to form a nip with the second roller 72. Additional embodiments of printers employing the web tension control method disclosed herein are configured by combining individual elements of the above-referenced embodiments; thus, this listing of embodiments is not exhaustive.

Referring still to FIG. 1, the actuator 74 is operatively connected to the second roller 72 and configured to rotate the second roller 72 to move the media web 20 past the second roller 72 in the process direction. In one embodiment, the second actuator 80 is operatively connected to the first roller 70 and configured to rotate the first roller 70 to advance the media web 20 along the media path. In an alternative embodiment, the third actuator 82 is operatively connected to the third roller and configured to selectively move the third roller 78 into and out of engagement with the media web 20 to form the nip with the second roller 72 and move the media web through the nip and past the second roller 72. Although the second and third actuators 80, 82 have been shown as alternative embodiments, a printer system using the web tension control method disclosed herein can employ both the second and third actuators 80, 82 in a single embodiment to control the first and third rollers 70, 78, respectively.

The printer 10 includes a controller 40 that is operatively connected to the tension sensor 76 and the actuator 74. In an alternative embodiment, the controller 40 is operatively connected to one or both of the second and third actuators 80, 82. The controller 40 is configured to identify the tension of the media web 20 with reference to signals generated by the tension sensor 76. The controller 40 is also configured to operate the actuator 74 to adjust the rotation of the second roller 72. In one embodiment, the controller 40 is similarly configured to operate the second actuator 80 to adjust the rotation of the first roller 70. In an alternative embodiment, the controller 40 is configured to activate the third actuator 82 to move the third roller 78 into engagement with the web 20 to form the nip with the second roller 72. Although the controller 40 has been shown with alternative configurations to operate the second and third actuators 80, 82, a printer operating the web tension control method disclosed herein can employ these configurations in a single embodiment to operate both of the second and third actuators 80, 82.

Referring still to FIG. 1, one embodiment of the printer 10 includes a first rotational speed sensor 84 configured to generate a signal corresponding to a rotational speed of the first roller 70 and a second rotational speed sensor 86 configured to generate a signal corresponding to a rotational speed of the second roller 72. The printer controller 40 is operatively connected to the first and second rotational speed sensors 84, 86. In this embodiment, the controller 40 is configured to identify the rotational velocities of the first and second rollers 70, 72 with reference to the signals generated by the first and second rotational speed sensors 86, 84, respectively. The controller 40 is further configured to identify the web linear velocity with reference to the identified rotational velocities of the first and second rollers 70, 72.

Although the disclosed embodiment is shown using rotational speed sensors 84, 86 to generate the rotational speed signals that are used by the controller to identify the web linear velocity, a web velocity sensor 87 can be configured to monitor the web directly and generate a signal corresponding to a linear velocity of the web. In this embodiment, the printer controller 40 is operatively connected to the web velocity sensor 87 and configured to receive the signal from sensor 87 that corresponds to the linear velocity of the web. The web velocity sensor 87 can be located anywhere along the media path, but is preferably located near the second roller 72. The sensors 84, 86, 87 are known sensors that operate with known techniques to generate their respective signals. Such techniques include mechanical, optical, radio, or laser techniques to measure a physical parameter and generate an electrical signal corresponding to the measurement.

Figure 2:
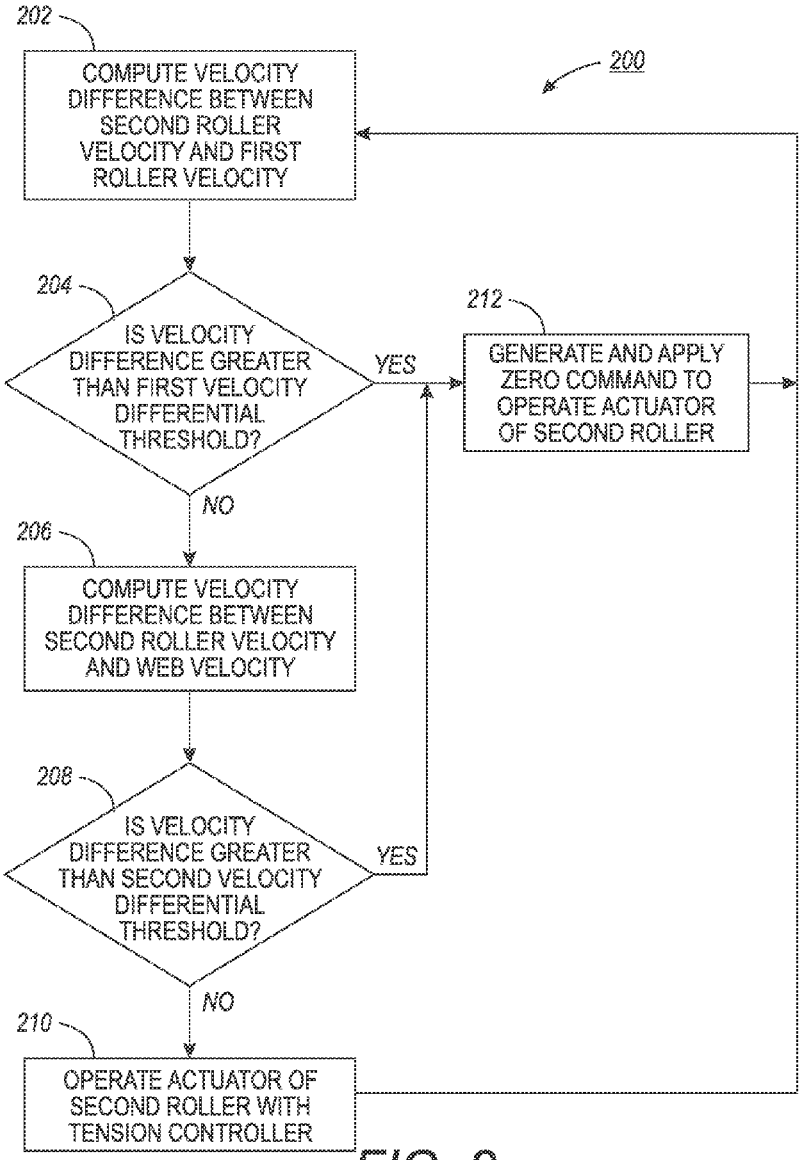
FIG. 2 is a flow diagram of one embodiment of a process for controlling web tension in a printer.

A flow diagram of a process 200 that controls the tension of the media web in a printer is shown in FIG. 2. The controller configured to execute the programmed instructions to implement the process 200 begins by computing a velocity difference between a velocity of the second roller and a velocity of the first roller (block 202). As the web is moved along the media path, the first and second rotational speed sensors generate respective signals corresponding to the rotational speeds of the first and second rollers. The controller implementing the process 200 transforms the signals into standardized quantities, such as linear velocities, and computes the difference between the second roller velocity and the first roller velocity. This velocity difference is positive if the difference between the second roller velocity and the first roller velocity is greater than zero. A positive velocity difference indicates the second roller is rotating faster than the first roller.

After the first velocity difference is computed (block 202), the controller configured to execute the programmed instructions to implement the process 200 determines whether the computed velocity difference is greater than a first velocity differential threshold (block 204). As use herein, the term "first velocity differential threshold" is a velocity differential or a range of velocity differentials that indicate the media web is engaged in static, or non-slip, friction with the first and second rollers. The controller implementing the process 200 compares the velocity difference to the first velocity differential threshold to determine whether the first velocity difference is greater than the first velocity differential threshold. Computing a positive velocity difference that is greater than the first velocity differential threshold can be indicative of the media web being slack or broken or of slipping contact between the media web and the second roller.

If the velocity difference is not greater than the first velocity threshold (block 204), the controller implementing the process 200 computes a velocity difference between the velocity of the second roller and the velocity of the web (block 206). As the web is moved along the media path, the second rotational speed sensor and the web velocity sensor generate respective signals corresponding to the rotational speed of the second roller and the linear velocity of the web. The controller implementing the process 200 transforms the signals into standardized quantities, such as linear velocities, and computes the difference between the second roller velocity and the web velocity. This roller/web velocity difference is positive if the difference of the second roller velocity to the web velocity is greater than zero. A positive roller/web velocity difference indicates that the second roller is rotating faster than the web is moving over the second roller.

After the velocity difference is computed (block 206), the controller implementing the process 200 determines whether the computed roller/web velocity difference is greater than a second velocity differential threshold (block 208). As used herein, the term "second velocity differential threshold" is a velocity differential or a range of velocity differentials that indicate the media web is engaged in static, or non-slip, friction with the second roller. The controller implementing the process 200 compares the velocity difference to the second velocity differential threshold to determine whether the velocity difference is greater than the second velocity differential threshold. Computing a positive roller/web velocity difference that is greater than the second velocity differential threshold can be indicative of the media web being slack or broken or of slipping contact between the media web and the second roller.

In one embodiment of the process 200, the first and second velocity differential thresholds are equal. In an alternative embodiment, the first and second velocity differential thresholds are different. Selecting the first and second velocity differential thresholds can depend on a number of operational parameters, such as the process speed of the printer, the weight and thickness of the web, and the like. In addition, in one embodiment of the process 200, only one of the velocity differences is computed. Similarly, and depending on which one of the velocity differences is computed, only one of the velocity differences is compared to the respective first or second velocity differential thresholds. Selecting which one of the velocity differences is computed can similarly depend on a number of operational parameters, such as those listed above.

If the computed velocity differences are not greater than the respective first and second velocity differential thresholds (blocks 204, 208), the controller implementing the process 200 operates the actuator with a tension controller, such as a servo or PID controller, to adjust the web tension (block 210). Under this type of actuator control, the tension controller receives signals from the tension sensor, transforms those signals into a standardized quantity, such as force or tension, and compares that measured tension to a desired tension, or a tension set. The tension controller then implements an algorithm to generate a varying command to operate the actuator to keep the web tension constant, or near constant, at the tension set.

The tension sensor is preferably located within or near the print zone of the media path; however, the tension measurement can be made anywhere along the media path between the first and second rollers. The tension sensor can employ any method to obtain the tension measurement, such as a load cell positioned at one of the idler rollers located between the first and second rollers. The tension set can be any tension value or range of tension values at or within the predetermined tension threshold. The tension set can be contained in the programmed instructions stored in memory and associated with the controller or can be entered by a user through an I/O device 41 as shown in FIG. 1. The I/O device 41 can include a user interface, graphical user interface, keyboards, pointing devices, displays, and other devices that allow externally generated information to be provided to the printer, and that allow internal information of the printer to be communicated externally.

Referring again to FIG. 2, if one or both of the computed velocity differences are greater than the respective first and second velocity differential thresholds (blocks 204, 208), the controller implementing the process 200 generates and applies a zero command to operate the actuator (block 212). In some embodiments, the zero command can also be used to operate one or both of the second and third actuators as is discussed in more detail below. The controller implementing the process 200 applies the zero or near zero command by sending unique command signals to the actuator and, optionally, to the second and third actuators. These unique command signals enable the printer to achieve tension in a web system when transient conditions of low friction or low normal force exist between the web and the first and second rollers. Thus, the controller implementing the process 200 determines whether to generate and apply the zero command or to generate and apply a varying command to operate the actuator based on the existence and magnitude of a computed velocity difference indicating web slip.

Figure 3:
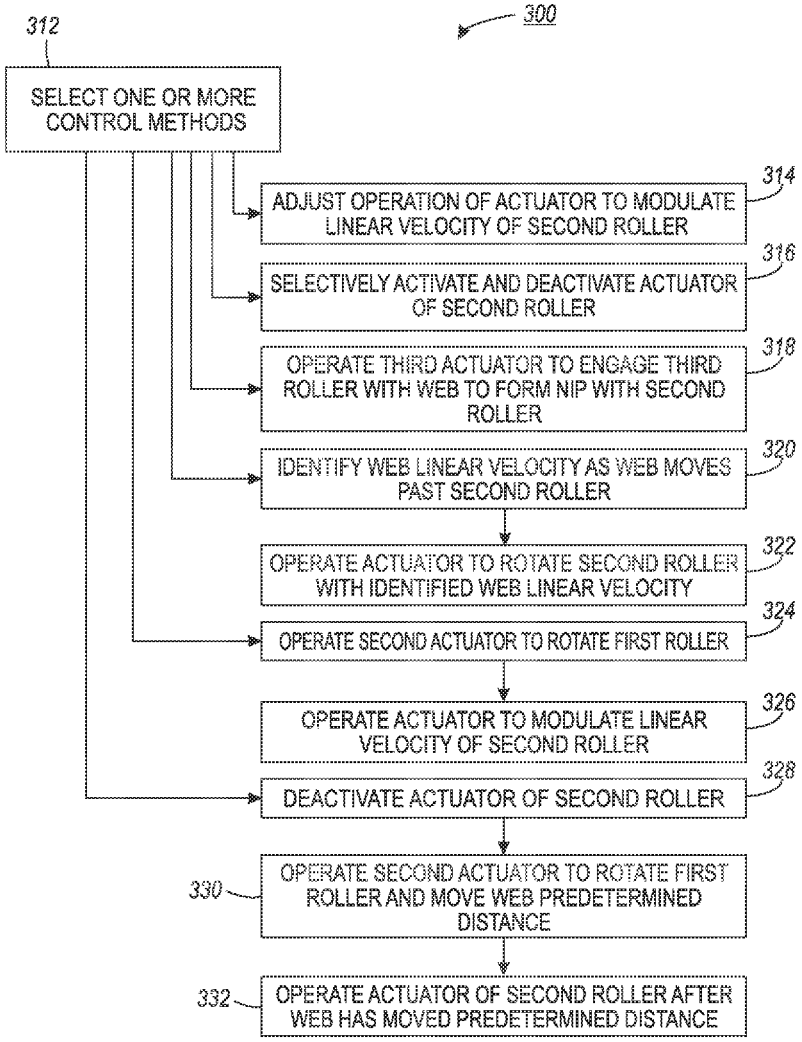
FIG. 3 is a flow diagram of a process for operating the components of a printer according to one embodiment of the web tension control method.
Figure 4:
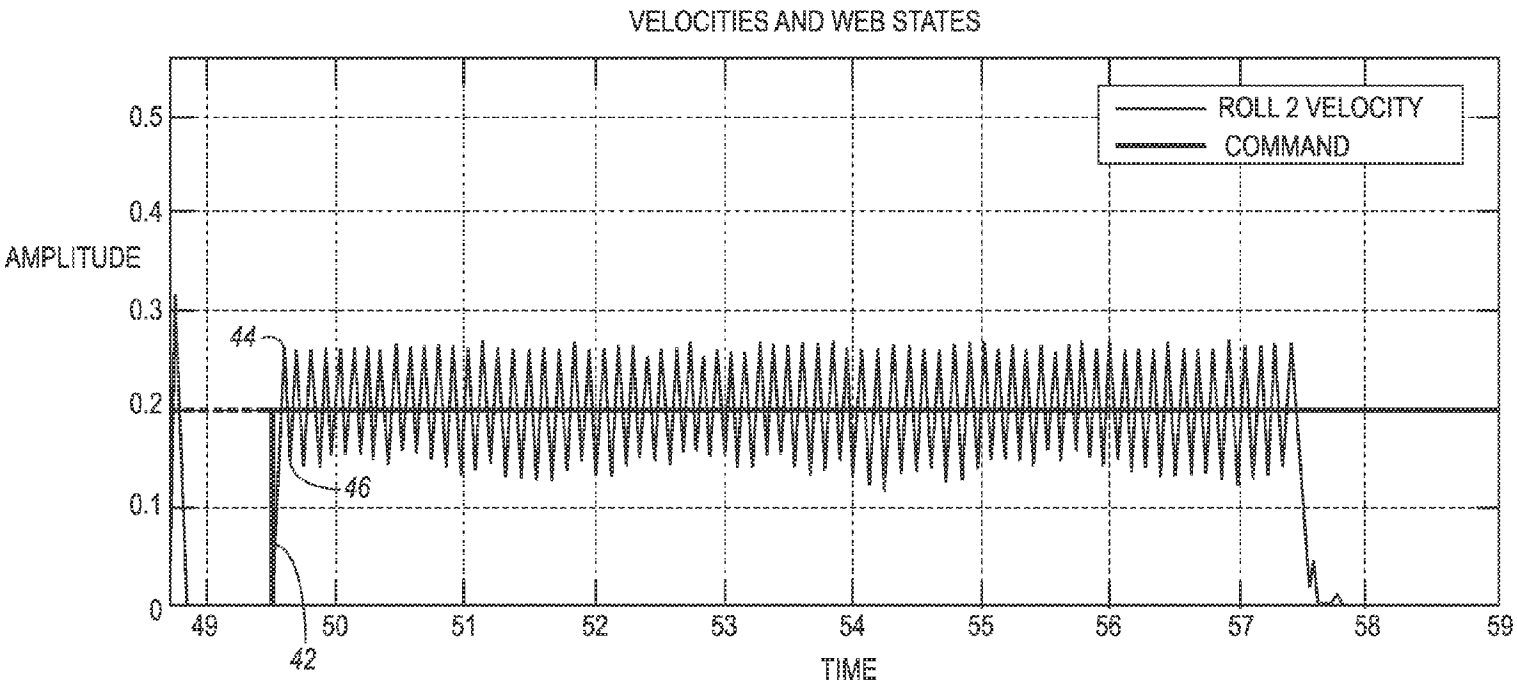
FIG. 4 is a graph of a velocity difference between a second roller and a first roller during operation of one embodiment of the web tension control method.

FIG. 3 depicts a flow diagram of a process 300 for operating the actuator, the second actuator, and the third actuator according to the zero command. The process 300 for operating the actuators is performed in block 212 of FIG. 2. The controller implementing the process 300 begins by selecting one or more control methods to operate the actuator and, optionally, the second and third actuators (block 312). In one control method, the actuator is operated to modulate the linear velocity of the second roller between a first linear velocity and a second linear velocity (block 314). Referring to FIG. 4, a graph of the velocity difference 42 between the second roller and the first roller in an example velocity modulation is shown. The linear velocity of the first roller is constant and in this graphical representation is located along a horizontal line passing through zero on the y-axis. Although the linear velocity of the first roller is represented as zero on the graph, the actual linear velocity of the first roller may be any velocity that moves the web along the media path.

The velocity difference 42 between the second roller and the first roller generally increases from zero at 49.5 on the x-axis and decreases to zero at approximately 57.5 on the x-axis during operation of the control method in this example. The increasing magnitude of the velocity difference starting at about 49.5 represents the second roller losing non-slip contact with the web while the decreasing magnitude of the velocity difference ending at about 57.5 represents the second roller regaining non-slip contact with the web.

Referring still to FIG. 4, the velocity modulation in this example is initiated when the velocity difference between the second roller and the first roller exceeds a velocity difference maximum 44. When the velocity difference maximum 44 is exceeded, the controller operates the actuator to modulate the linear velocity of the second roller between the first and second linear velocities. The first linear velocity is represented by the velocity difference maximum 44 and the second linear velocity is represented by lowest velocity difference value 46 immediately following the velocity difference maximum 44. The modulation of the linear velocity of the second roller is repeated until neither of the computed velocity differences are greater than the respective first and second velocity differential thresholds (block 210).

Figure 5:
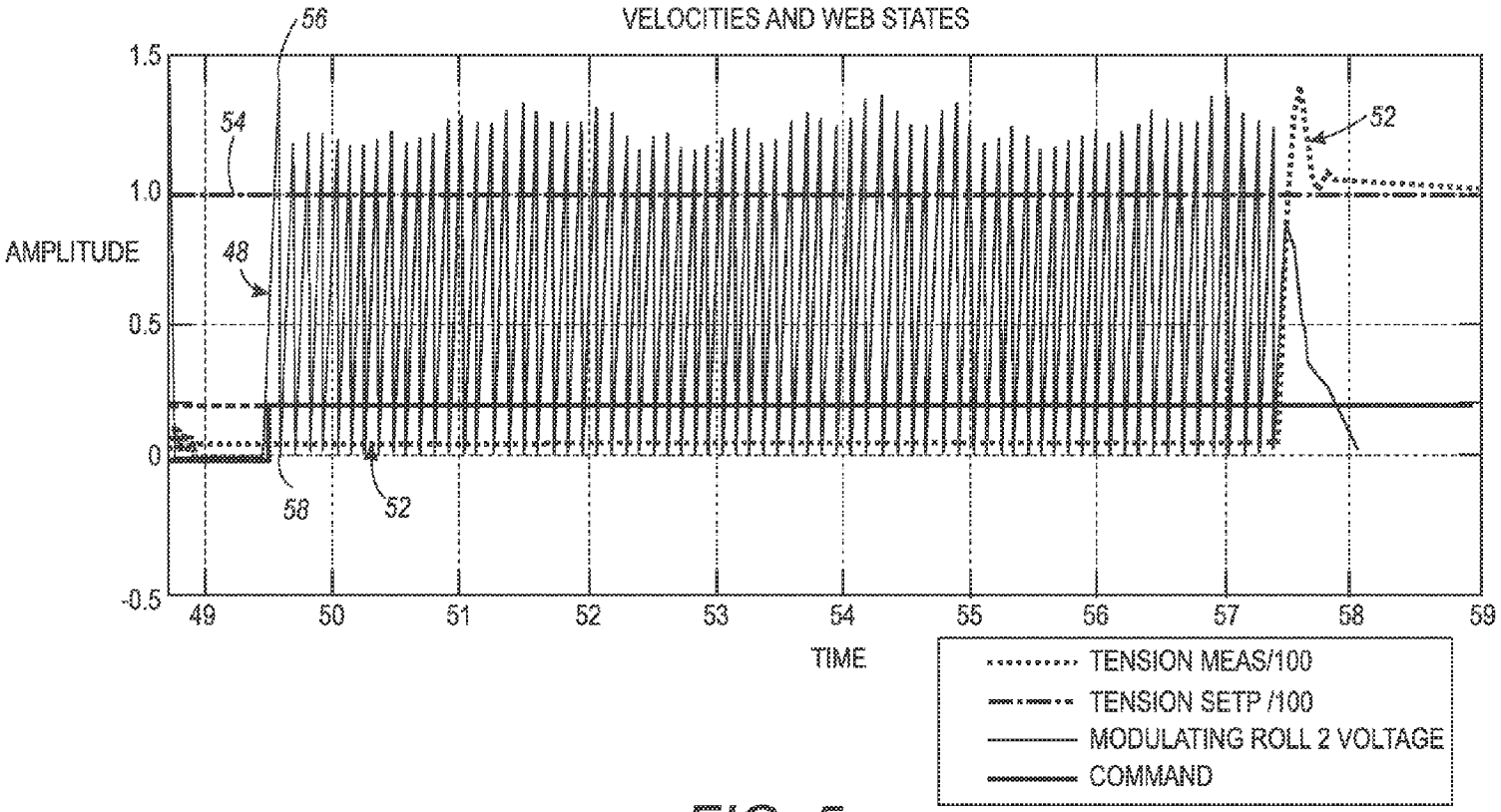
FIG. 5 is a graph of a signal provided to an actuator during operation of the web tension control method in FIG. 4.

Referring to FIG. 5, a graph of the signal 48 provided to the actuator during the velocity modulation in this example is shown. The measured web tension 52 extends across the entirety of the graph from approximately 49 on the x-axis to 59 on the x-axis. The measured tension 52 is approximately zero until about 57.5 on the x-axis where the measured tension exceeds the tension set point 54. Referring to FIGS. 4 and 5, to perform the velocity modulation of the second roller between the first and second velocities 44, 46, the signal 48 to the actuator is modulated between a signal maximum 56 and a signal minimum 58. The signal maximum 56 is any signal having an amplitude that causes the second roller to rotate at the first linear velocity 44. The signal minimum 58 is any signal having an amplitude that causes the second roller to rotate at the second linear velocity 46. The amplitude of the signal 48 can be reduced to zero to cause the second roller to rotate at the second linear velocity 46. However, the signal 48 can also be reduced to an amplitude lower than the signal maximum 56 and greater than zero to cause the second roller to rotate at the second linear velocity 46.

Referring again to FIG. 3, in another control method the controller implementing the process 300 deactivates the actuator to enable the second roller to rotate at a linear velocity (block 328). The actuator can be deactivated by any means, such as by reducing or suspending the signal to the actuator. Deactivation of the actuator in this method quickly reduces the linear velocity of the second roller. In yet another control method, the actuator is selectively activated and deactivated to rotate the second roller at a linear velocity (block 316). The actuator can be selectively activated by any means, such as by providing the signal to the actuator for a discrete duration or by providing the signal to the actuator until the actuator rotates at a predetermined linear velocity. The actuator can be selectively deactivated in a similar manner to the selective activation of the actuator. The selective activation and deactivation of the actuator in this method provides a more controlled deceleration of the second roller to match the linear velocity of the web.

In yet another control method, the controller implementing the process 300 operates the third actuator to move the third roller into engagement with the second roller to form a nip with the second roller (block 318). The formation of the nip between the second and third rollers urges the web into contact with the second roller. Operation of the second roller after formation of the nip advances the web past the second roller to enable the printer to achieve tension when conditions of low friction or low normal force exist between the web and the first and second rollers.

In yet another control method, the controller implementing the process 300 identifies the linear velocity of the web (block 320) and then operates the actuator to rotate the second roller with the identified linear velocity (block 322). In one embodiment, the linear velocity of the web is identified by first measuring the rotational velocities of the first and second rollers and then by calculating the linear velocity of the web with reference to the measured linear velocities of the first and second rollers. In an alternative embodiment, the web velocity can be measured directly. In another embodiment, the measured velocities of the first roller, the second roller, and the web can be used to identify the linear velocity of the web.

In yet another control method, the controller implementing the process 300 operates the second actuator to rotate the first roller with the third linear velocity (block 324) and then actuates the actuator to modulate the linear velocity of the second roller between the first and third linear velocities (block 326). The velocity of the second roller is modulated in the same manner as the velocity modulation control method described in block 314. In yet another control method, the controller implementing the process 300 deactivates the actuator of the second roller (block 328), operates the second actuator to rotate the first roller to move the web a predetermined distance (block 330), and activates the actuator to rotate the second roller after the web has moved the predetermined distance (block 332). In this control method, deactivation of the actuator (block 328) and operation of the second actuator to rotate the first roller (block 330) advance the media web along media path and past the second roller. Subsequent activation of the actuator to rotate the second roller after the web has moved the predetermined distance allows the second roller to engage a new portion of the web. After implementation of one or more of the control methods disclosed in blocks 314-332 of process 300, the controller implementing the process 200 computes one or both of the velocity differences (blocks 202, 206) and assesses whether either of the computed velocity differences are greater than the respective first and second velocity differential thresholds (blocks 204, 208).

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A method of controlling a web in a printing apparatus comprising:

moving a web over a first roller and along a media path in a process direction at a web linear velocity;

operating an actuator to rotate a second roller that is in contact with the web, the second roller being at a location on the media path that is offset from the first roller in the process direction;

identifying at least one of a first velocity difference and a second velocity difference between a linear velocity of the second roller and at least one of a linear velocity of the first roller and the web linear velocity, respectively, the at least one of the first and second velocity differences being positive when the linear velocity of the second roller is greater than the at least one of the linear velocity of the first roller and the web linear velocity, respectively; and adjusting operation of the actuator to modulate the linear velocity of the second roller between a first linear velocity and a second linear velocity in response to the identified at least one of the first and second velocity differences being positive and above at least one of a first velocity differential threshold and a second velocity differential threshold, respectively, the first linear velocity being greater than the second linear velocity and the first and second linear velocities being greater than the at least one of the linear velocity of the first roller and the web linear velocity.

2. The method of claim 1 further comprising:

deactivating the actuator to enable the second roller to rotate at a linear velocity.

3. The method of claim 1 further comprising:

selectively activating and deactivating the actuator to rotate the second roller at a linear velocity.

4. The method of claim 1 further comprising:

moving a third roller into engagement with the web to form a nip with the second roller and to advance the web past the second roller.

5. The method of claim 1 further comprising:

identifying the web linear velocity as the web moves past the second roller; and operating the actuator to rotate the second roller with the identified web linear velocity.

6. The method of claim 5, the identification of the web linear velocity further comprising:

identifying a rotational velocity of the first roller;

identifying a rotational velocity of the second roller;

identifying the web linear velocity with reference to the rotational velocity of the first roller and the rotational velocity of the second roller.

7. The method of claim 1 further comprising:

rotating the first roller with a second actuator to rotate the first roller with the third linear velocity; and operating the actuator to modulate the linear velocity of the second roller between the first and third linear velocities.

8. The method of claim 1 further comprising:

deactivating the actuator of the second roller;

operating a second actuator to rotate the first roller and move the web a predetermined distance along the media path in the process direction; and activating the actuator to rotate the second roller after the web has moved the predetermined distance along the media path.

9. A printing apparatus comprising:

a plurality of rollers configured to move a media web along a media path in a process direction, a first roller in the plurality of rollers rotates to move the web in the process direction at a web linear velocity, and a second roller in the plurality of rollers is positioned along the media path at a location that is offset from the first roller in the process direction;

an actuator operatively connected to the second roller, the actuator being configured to rotate the second roller to move the media web past the second roller in the process direction; and a controller operatively connected to the actuator, the controller being configured to:

operate the actuator to adjust a rotation of the second roller to move the media web past the second roller;

identify at least one of a first velocity difference and a second velocity difference between a linear velocity of the second roller and at least one of a linear velocity of the first roller and the web linear velocity, respectively, the at least one of the first and second velocity differences being positive when the linear velocity of the second roller is greater than the at least one of the linear velocity of the first roller and the web linear velocity, respectively; and adjust operation of the actuator to modulate a linear velocity of the second roller between a first linear velocity and a second linear velocity in response to the identified at least one of the first and second velocity differences being positive and above at least one of a first velocity differential threshold and a second velocity differential threshold, respectively, the first linear velocity being greater than the second linear velocity and the first and second linear velocities being greater than the at least one of the linear velocity of the first roller and the web linear velocity.

10. The printing apparatus of claim 9, the controller being further configured to:

deactivate the actuator to enable the second roller to rotate at a linear velocity.

11. The printing apparatus of claim 9 further comprising:

a third roller positioned proximate the second roller;

a third actuator configured to selectively move the third roller into and out of engagement with the media web to form a nip with the second roller and move the media web through the nip and past the second roller; and the controller being operatively connected to the third actuator and further configured to:

activate the third actuator to move the third roller into engagement with the web to form the nip.

12. The printing apparatus of claim 9, the controller being further configured to:

operate the actuator to rotate the second roller at a linear velocity.

13. The printing apparatus of claim 9 further comprising:

a second actuator operatively connected to the first roller and configured to rotate the first roller with the third linear velocity; and the controller being operatively connected to the second actuator and configured to operate the actuator to modulate the linear velocity of the second roller between the first and third linear velocities.

14. The printing apparatus of claim 13, the controller being further configured to:

deactivate the actuator;

activate the second actuator to rotate the first roller and move the media web a predetermined distance along the media path in the process direction; and activate the actuator to rotate the second roller after the media web has moved the predetermined distance along the media path.

15. The printing apparatus of claim 9, the media path being configured to place at least one half of an outer circumference of the second roller in contact with the media web.

16. The printing apparatus of claim 9 further comprising:

a first rotational speed sensor configured to generate a signal corresponding to a rotational speed of the first roller;

a second rotational speed sensor configured to generate a signal corresponding to a rotational speed of the second roller; and a controller operatively connected to the first rotational speed sensor and to the second rotational speed sensor, the controller being further configured to identify a rotational velocity of the first roller with reference to the signal generated by the first rotational speed sensor, identify a rotational velocity of the second roller with reference to the signal generated by the second rotational speed sensor, and identify the web linear velocity with reference to the rotational velocity of the first roller and the rotational velocity of the second roller.

17. The printing apparatus of claim 16, the controller being further configured to:

identify the web linear velocity as the media web moves past the second roller with reference to signals generated by the first and second rotational speed sensors; and operate the actuator to rotate the second roller with the identified web linear velocity.

* * * * *